US007195054B2

(12) United States Patent
Marti et al.

(10) Patent No.: US 7,195,054 B2
(45) Date of Patent: Mar. 27, 2007

(54) METHOD AND DEVICE FOR SEALING A GAP BETWEEN A ROLLER FRONT FACE AND SIDE SEAL ON A ROLLER-STRIP-CASTING MACHINE

(75) Inventors: Heinrich Marti, Forch (CH); Jacques Barbé, Tarantaise (FR); Dominique Salathè, Sursee (CH); Alfred Koch, Stansstad (CH)

(73) Assignees: SMS Demag AG, Düsseldorf (DE); Main Management Inspiration AG, Hergiswil (CH)

( * ) Notice: Subject to any disclaimer, the term of this patent is extended or adjusted under 35 U.S.C. 154(b) by 257 days.

(21) Appl. No.: 10/489,889

(22) PCT Filed: Sep. 13, 2002

(86) PCT No.: PCT/EP02/10278

§ 371 (c)(1),
(2), (4) Date: Aug. 13, 2004

(87) PCT Pub. No.: WO03/024646

PCT Pub. Date: Mar. 27, 2003

(65) Prior Publication Data

US 2004/0251638 A1 Dec. 16, 2004

(30) Foreign Application Priority Data

Sep. 18, 2001 (CH) ..... 1714/01

(51) Int. Cl.
*B22D 11/06* (2006.01)
*B22D 27/02* (2006.01)

(52) U.S. Cl. ..... 164/480; 164/428; 164/467; 164/503

(58) Field of Classification Search ..... 164/428, 164/480, 466–467, 502–503
See application file for complete search history.

(56) References Cited

U.S. PATENT DOCUMENTS 4,936,374 A 6/1990 Pareg
4,951,736 A * 8/1990 Yukumoto et al. ..... 164/428
4,974,661 A * 12/1990 Lari et al. ..... 164/503

FOREIGN PATENT DOCUMENTS

DE 4438119 5/1996

* cited by examiner

*Primary Examiner*—Kuang Y. Lin
(74) *Attorney, Agent, or Firm*—Friedrich Kueffner

(57) ABSTRACT

The reliable sealing of a gap (10), between a roller front face (7) and a side seal (3) on a roller-strip-casting machine is achieved by the generation of an electrical eddy field in the region of the gap (10), such as to produce a local gradient field (13). The eddy currents generated in the metal melt for casting prevent the ingress of the metal into the gap (10) or eject the metal from the gap (10). The risk of escape of liquid metal is essentially eliminated and the formation of ridges on the narrow edge of the metal strip avoided.

12 Claims, 3 Drawing Sheets

METHOD AND DEVICE FOR SEALING A GAP BETWEEN A ROLLER FRONT FACE AND SIDE SEAL ON A ROLLER-STRIP-CASTING MACHINE

BACKGROUND OF THE INVENTION

The invention concerns a method for sealing a gap between an end face of a roll and a side seal of a roll strip-casting machine and a device for carrying out this method.

It is well known that, in a twin-roll strip-casting machine for casting metal strip, especially steel strip, side seals, preferably in the form of ceramic plates, can be installed in the region of the end faces of the casting rolls. A sealing gap, whose capillary action is used to produce the seal, is formed between the given end face of the roll and the given side seal. However, extremely small fluctuations in the capillary gap can cause the low-viscosity, molten steel to penetrate the gap, which results in the formation of flash on the narrow edge of the steel strip, which gives rise to the risk of unacceptable wear of the casting rolls and/or the side seals and may also damage the rolls of a downstream rolling stand. Damage may also be caused by the potential emergence of the molten steel. The irregularities on the narrow edge of the strip must be removed by cutting off the edges, which results in both extra work and reduced output.

SUMMARY OF THE INVENTION

The objective of the present invention is to propose a method of the aforementioned type and a device for carrying out this method, by which the risk of emergence of molten metal is largely eliminated, and the formation of flash on the narrow edge of the metal strip is avoided.

In accordance with the invention, as a result of the fact that a rotational electric field is generated in the region of the gap in such a way that a local gradient field is produced, and the eddy currents generated in the molten metal to be cast prevent the molten metal from penetrating the gap or force the molten metal out of the gap, the capillary action in the sealing gap is effectively supported, a reliable seal is ensured, and thus better quality of the edges of the cast strip and a reduction of the scrap are achieved. A special advantage here is the relatively small power consumption for generating the local rotational field.

Preferred refinements of the method and device are the objects of the dependent claims.

The invention is explained in greater detail below with reference to the drawings.

DETAILED DESCRIPTION OF THE INVENTION

Figure 1:
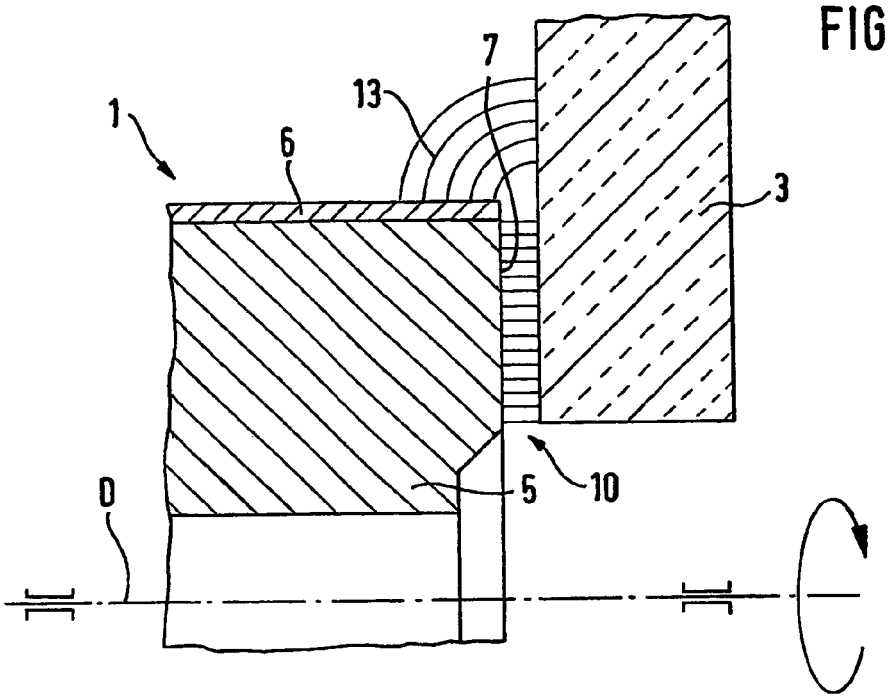
FIG. 1 is a schematic representation of the principle of the invention for sealing a gap between the end face of a roll and a side seal.

FIG. 1 shows a partial section of a casting roll 1 of a twin-roll strip-casting machine for casting a metal strip, especially a steel strip. This casting roll 1 is also schematically indicated in FIG. 2, along with a second casting roll 2. A mold space (labeled 5 in FIG. 2) for the molten metal is bounded by the two casting rolls 1, 2, on the one hand, and by two side seals 3 installed in the region of the end faces of the rolls 1, 2, on the other hand. A through-gap 4 (FIG. 2), through which the metal strip that has been produced is carried away, is present between the two rolls 1, 2, which can be rotated about horizontal axes of rotation D (FIG. 1).

As shown in FIG. 1, each of the rolls 1, 2 consists of a basis material 5, preferably copper, and is provided with a surface layer 6, which consists of a wear-resistant material. The side seals 3 are generally composed of a ceramic material.

As FIG. 1 shows on an enlarged scale, a sealing gap 10 is present between an annular end face 7 of the roll 1 and the corresponding side seal 3. To prevent molten metal from penetrating this sealing gap 10 (thereby producing flash on the narrow edge of the metal strip) or even escaping through this sealing gap 10, not only is the capillary action in this sealing gap 10 utilized, but also, in accordance with the invention, a rotational electric field is induced in such a way that a local gradient field is produced in the region of the sealing gap 10. This local gradient field is schematically indicated in FIG. 1 and is labeled with reference number 13. It results in a force that opposes the penetration of the molten metal into the sealing gap 10.

Figure 3:
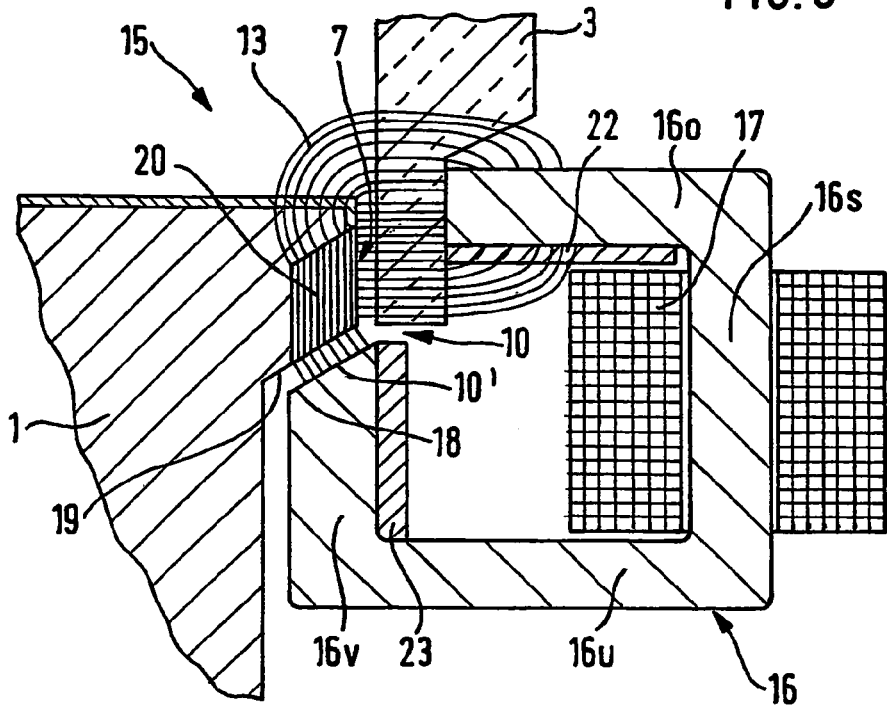
FIG. 3 shows a first embodiment of one of the magnetic elements in FIG. 2 in the cross section along line A.
Figure 4:
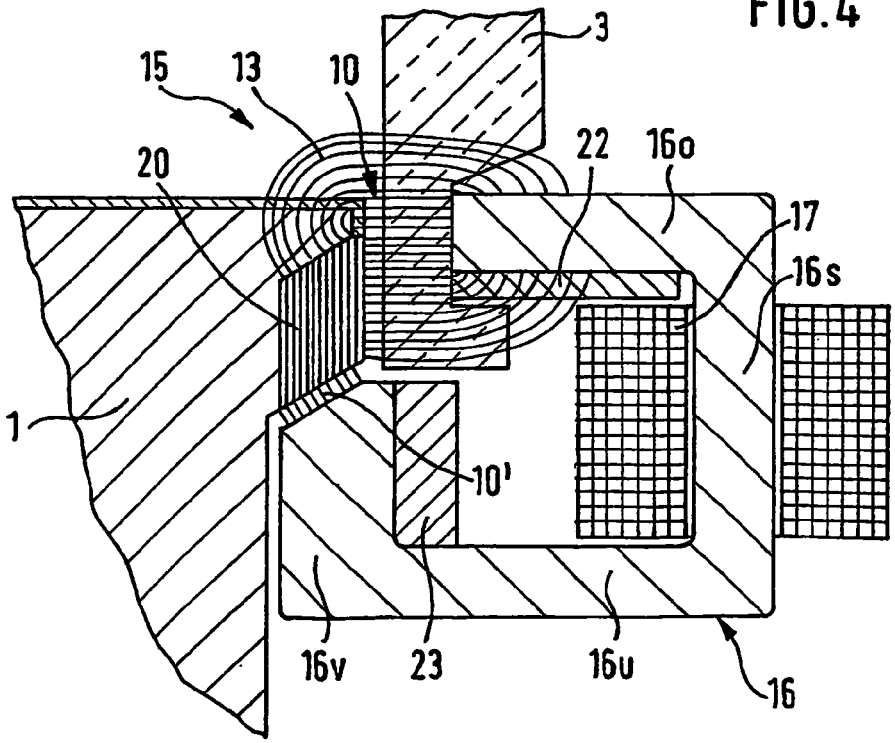
FIG. 4 shows a second embodiment of one of the magnetic elements in FIG. 2 in the cross section along line A.
Figure 5:
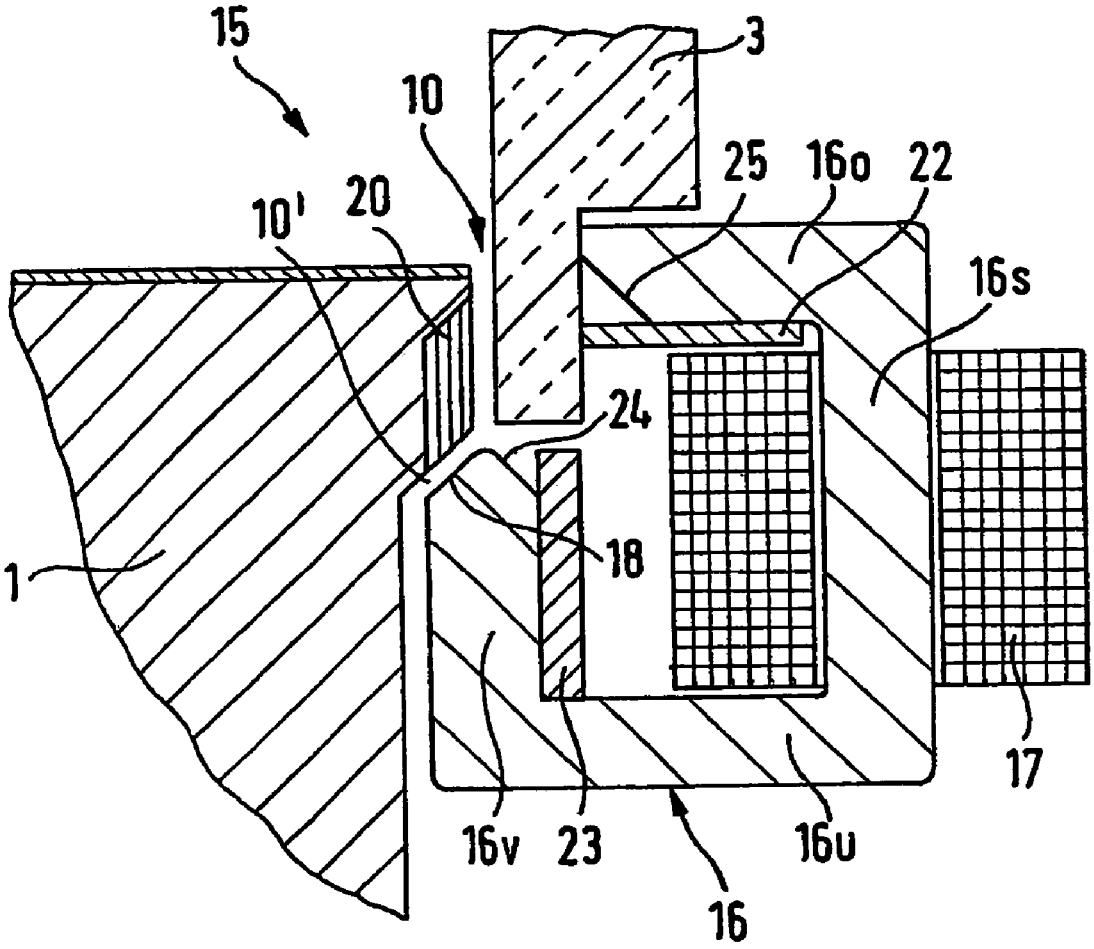
FIG. 5 shows a third embodiment of one of the magnetic elements in FIG. 2 in the cross section along line A.

To induce the local rotational electric field, several magnetic elements 15 are arranged in succession along the circumference of the roll in the region of the mold space 5 and the associated sealing gap between each end face 7 of a roll and the associated side seal 3. The magnetic elements 15 are permanently arranged and are preferably mounted on the side seals 3, so that, during a roll change, they can be easily removed, together with the side seals 3, by means of a manipulator, which is not shown in the drawing. The design of the individual magnetic elements 15 is shown in FIGS. 3 to 5. Of course, other designs of the magnetic element would be possible in addition to the three embodiments shown here.

In accordance with the invention, it is advantageous to arrange the individual magnetic elements 15 in a row as modules distributed along the particular roll circumference from top to bottom as far as the through-gap 4. They cover approximately the entire length of the side seal 3, which runs along the given casting roll 1, 2.

Figure 2:
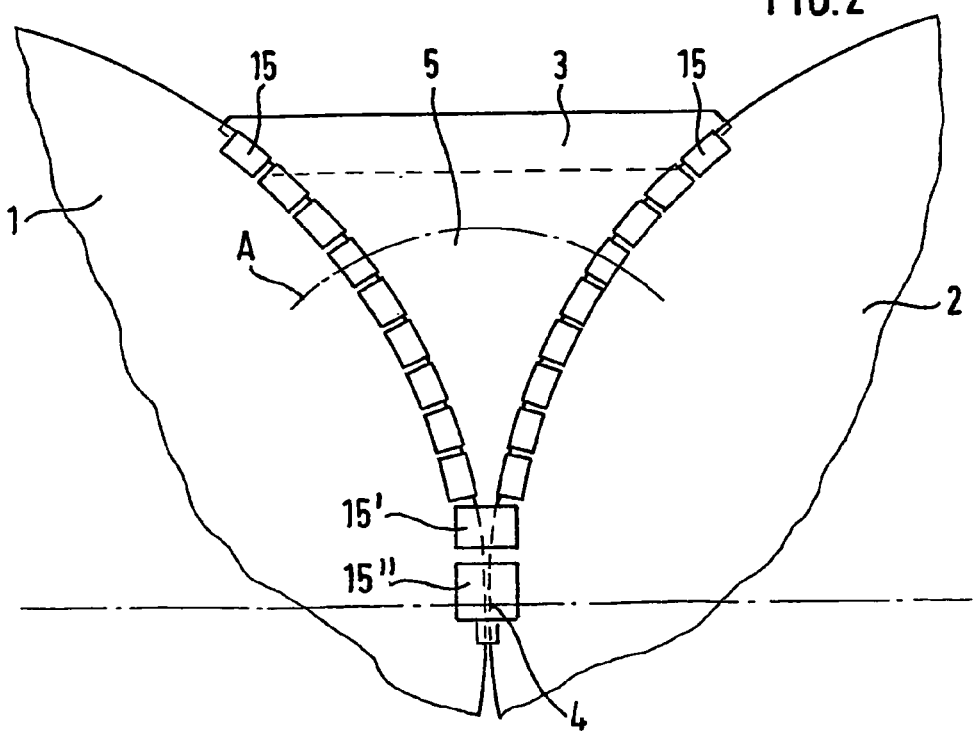
FIG. 2 is a schematic representation of the arrangement of a number of magnetic elements for inducing a rotational electric field, which are arranged along the end faces of the rolls in the region of the mold of a strip-casting machine.

In the embodiment shown in FIG. 2, the two lowermost sets of magnetic elements 15', 15" of the two rolls 1, 2, which are located in the immediate vicinity of the through-gap 4, are combined into single magnetic elements. The individual magnetic elements 15, which are suitably designed accordingly, are preferably provided with independently controllable power supplies, and they are independently controlled according to process requirements and pressure level. Preferably, opposing magnetic elements 15 located at the same height (i.e., the same distance from the through-gap 4) in front of the end face of the two rolls 1, 2 are controlled together in each case.

As is apparent from FIGS. 3 to 5, each magnetic element 15 comprises a laminated iron body 16 composed of essentially L-shaped plates or an iron body 16 produced by a sintering process and an associated coil 17. These are used to produce an alternating magnetic field in the frequency range of 300 to 3,000 kHz. This alternating field induces the formation of electric eddy currents, which flow through the molten steel (or other electrically conductive metal) and, as has already been mentioned, locally opposes the penetration of the molten metal into the sealing gap 10. The magnetic elements 15 distributed along the circumference of the given roll from top to bottom immediately adjoin each other. In a preferred design, the given iron body 16 has half the length in the coil region 16*s*, as viewed in the circumferential direction of the roll 1 or 2, and the L-shaped plates are layered in an overlapping fashion in the coil region, so that the same cross section is formed over the entire length in the field direction of the iron body 16 as inside the coil 17.

The upper region 16*o* of the iron body 16 is supported from the outside on the side seal 3 and mounted by means that are not shown. A lower region 16*u* is joined with a forward region 16*v* of the iron body that extends upward to the sealing gap 10. To intensify the gradient formation of the rotational electric field in the active air gap between the parts 16*o*, 16*v* of the iron body and in the sealing gap 10, a "field guide" (20) is built into the end face 7 of the roll. The field guide is formed by a ferromagnetic, laminated, or sintered ring or by one or more ring segments. An upper surface 18 of the region 16*v* of the iron body runs parallel to a surface 19 of the field guide 20 and the roll end face 7, which results, for example, in the formation of an obliquely running part 10' of the sealing gap 10.

Copper plates 22, 23, which likewise influence the gradient formation of the rotational electric field 13 and force the stray field in the direction of the sealing gap 10, are preferably installed inside the iron body 16. If necessary, two copper plates 22, 23 are present. They simultaneously serve as cooling elements.

As a comparison of FIGS. 3 to 5 shows, the iron bodies 16, the side seals 3, the field guides 20, and the copper plates 22, 23 may have different cross-sectional shapes and dimensions. Suitable field guides could also be installed in side seals 3 (instead of on the end face 7 of the roll or in addition to this). FIG. 5 shows that the gradient formation in the region of the sealing gap can also be optimized by modifying the air gap by installing other, additional oblique surfaces 24 and 25 on the iron body 16.

The invention is sufficiently defined with the embodiments explained above. However, it could also be illustrated in other variants. For example, the number of magnetic elements 15 provided per row could be varied, i.e., in principle, it would be possible to provide only one magnetic element or to provide more than eleven (as shown).

The particular gap 10 between the end face 7 of the roll and the side seal 3 may be formed either by mutual positioning or by arrangement of the two some distance apart.

The invention claimed is:

1. Method of sealing a gap between the end face of a casting roll (1, 2) and a side seal (3) of a roll strip-casting machine, comprising the steps of: inducing a rotational electric field in a region of the gap (10) in such a way that a local gradient field (13) is produced, whereby eddy currents generated in the molten metal to be cast prevent the molten metal from penetrating the gap (10) or force the molten metal out of the gap (10), such that a "field guide" (20) is built into an end face (7) of the roll, wherein the roll (1, 2) has a basis material (5), and a wear-resistant surface layer (6); positioning the "field guide" (20) relative to the surface of the roll in such a way that the basis material (5) and the wear-resistant layer (6) extend to the end face (7) of the roll; installing copper plates (22, 23) inside the iron body (16) of a magnetic element for influencing the gradient formation of the rotational electric field, the copper plates (22, 23) simultaneously serving as cooling elements.

2. Method in accordance with claim 1, including inducing the rotational electric field by an alternating magnetic field with a frequency range of 300–3,000 kHz.

3. Method in accordance with claim 1, including inducing the rotational electric field by at least one magnetic element (15) installed in front of the end face of the roll.

4. Method in accordance with claim 3, including inducing the rotational electric field by a number of magnetic elements (15) mounted on the side seal (3) and arranged in the mold region (5) of the strip-casting machine along the end face (7) of the given roll.

5. Method in accordance with claim 4, including modularly distributing the magnetic elements (15) and providing the magnetic elements (15) with independently controllable power supplies, which can be controlled according to process requirements and pressure level.

6. Method in accordance with claim 1, including optimizing the gradient formation of the rotational electric field in the region of the gap (10) by installing "field guides" (20) in the form of ferromagnetic, laminated, or sintered elements on the end face (7) of the roll and/or on the side seal (3).

7. Method in accordance with claim 6, including using ferromagnetic rings or ring segments built into the end face of the roll as field guides (20).

8. Device for sealing an air gap between the end face of a casting roll (1, 2) and a side seal (3) of a roll strip-casting machine, comprising: at least one magnetic element (15), which comprises a coil (17) and an iron body (16) that forms the air gap, wherein the iron body (16) is installed in such a way that a gradient field is generated in the air gap in the region of the gap (10) between the end face (7) of the roll and the side seal (3); and copper plates (22, 23) are installed inside the iron body (16) for optimizing the gradient field to be generated and for cooling.

9. Device in accordance with claim 8, wherein the magnetic element (15) is mounted on the side seal (3).

10. Device in accordance with claim 8, wherein the gap (10) between the end face (7) of the roll and the side seal (3) is formed either by mutual positioning of the end face (7) and the side seal (3) or by arrangement of the roll some distance from the side seal (3).

11. Device in accordance with claim 8, wherein a number of magnetic elements (15) arranged in a row are installed in the mold region (5) of the roll strip-casting machine along the given end face (7) of the roll, such that opposing magnetic elements (15) located at the same height in front of the end face of the two rolls (1, 2) are controlled together in each case.

12. Device in accordance with claim 8, wherein a number of magnetic elements (15) arranged in a row are installed in the mold region (5) of the roll strip-casting machine along the given end face (7) of the roll, such that each set of magnetic elements (15', 15") located in the immediate vicinity of a through-gap (4) present between the two rolls (1, 2) is combined into a single magnetic element.

* * * * *